US006827637B2

(12) United States Patent
Lewin et al.

(10) Patent No.: US 6,827,637 B2
(45) Date of Patent: Dec. 7, 2004

(54) WATERJET CUTTING SYSTEM AND METHOD OF OPERATION

(75) Inventors: David M. Lewin, Hiawatha, NJ (US); Timothy D. O'Keeffe, Budd Lake, NJ (US)

(73) Assignee: Service Metal Fabricating, Inc., Rockaway, NJ (US)

( * ) Notice: Subject to any disclaimer, the term of this patent is extended or adjusted under 35 U.S.C. 154(b) by 127 days.

(21) Appl. No.: 10/075,002

(22) Filed: Feb. 13, 2002

(65) Prior Publication Data

US 2002/0173220 A1 Nov. 21, 2002

Related U.S. Application Data

(60) Provisional application No. 60/268,313, filed on Feb. 13, 2001.

(51) Int. Cl.[7] ..... B24C 5/04

(52) U.S. Cl. ..... 451/75; 451/30; 451/41; 451/89; 451/102; 251/61.1; 251/61.2; 251/137

(58) Field of Search ..... 451/2, 30, 41, 451/60, 75, 89, 91, 99, 101, 102; 251/61.1, 61.2, 129.04, 137, 331

(56) References Cited

U.S. PATENT DOCUMENTS

| | | | | |
|---|---|---|---|---|
| 3,629,976 A | * | 12/1971 | Carpenter, Jr. | 451/101 |
| 4,862,649 A | | 9/1989 | Davis et al. | |
| 5,279,075 A | * | 1/1994 | Sage et al. | 451/2 |
| 5,441,441 A | * | 8/1995 | Cook et al. | 451/36 |
| 5,626,508 A | * | 5/1997 | Rankin et al. | 451/102 |
| 5,643,058 A | * | 7/1997 | Erichsen et al. | 451/99 |
| 5,785,582 A | * | 7/1998 | Stefanik et al. | 451/102 |
| 5,851,139 A | * | 12/1998 | Xu | 451/102 |
| 6,012,653 A | * | 1/2000 | Gunther et al. | 239/434 |
| 6,077,152 A | * | 6/2000 | Warehime | 451/75 |
| 6,435,950 B1 | * | 8/2002 | Pettit et al. | 451/60 |
| 6,464,567 B2 | * | 10/2002 | Hashish et al. | 451/38 |

* cited by examiner

*Primary Examiner*—Joseph J. Hail, III
*Assistant Examiner*—Anthony Ojini
(74) *Attorney, Agent, or Firm*—Lerner, David, Littenberg, Krumholz & Mentlik, LLP

(57) ABSTRACT

A waterjet cutting system and method of operating such system are disclosed. The waterjet cutting system includes an inflatable and deflatable diaphragm to control the mixing of abrasive particulate material and liquid in a stream used to abrade a target object.

38 Claims, 5 Drawing Sheets

WATERJET CUTTING SYSTEM AND METHOD OF OPERATION

CROSS-REFERENCE TO RELATED APPLICATIONS

The present application claims the benefit of U.S. Provisional Application No. 60/268,313, filed Feb. 13, 2001, the disclosure of which is hereby incorporated by reference herein.

FIELD OF THE INVENTION

The present invention relates to waterjet cutting systems and methods of operating same. More particularly, the present invention relates to an apparatus that controls the delivery of abrasive particulate material from a storage chamber to the outlet of a waterjet cutting machine. Further, the present invention relates to a method of controlling the flow of abrasive particulate material to a nozzle of such waterjet cutting machine.

BACKGROUND OF THE INVENTION

Abrasive waterjet cutting systems, where useful work is done by the abrasion of material through the influence of a concentrated stream of highly pressurized water entrained with abrasive particulates, have been known and used for many years. Typically, highly purified water is pressurized to upwards of 50,000 psi and is released through an abrasive waterjet cutting nozzle. As the water passes through the constricting nozzle body, it generates a vacuum via the venturi process. This vacuum serves to assist the delivery of abrasives to the water stream. Because of the venturi action, abrasive particulate material is drawn from a storage chamber and into the nozzle, is entrained in the water flow, and exits the nozzle with the water flowing at a velocity several times the speed of sound. This great speed provides the energy required to abrade the target material. However, this great speed also poses the problem of excessive consumption of the abrasive particulate. To alleviate this over consumption, a vacuum break system is typically provided.

Control of the waterjet cutting system may be by manual operation. However, it is also known, and is generally preferable, to use Computer Numeric Control (CNC) systems where the precise timing of the flow of water and inclusion of abrasive material is orchestrated with the movements of the nozzle or material being cut through the use of a computer. Such movement of the nozzle or material being cut will, therefore, be power assisted and at least partially automated.

Existing waterjet cutting machines have utilized various types of abrasive particulate materials. For example, garnet, silica, aluminum oxide, and the like, have been used as abrasive particulate materials that are mixed with water and transmitted under high pressures through an associated nozzle of waterjet cutting devices.

The operation of an abrasive waterjet cutting system requires the cutting stream to be periodically cycled from a full flow to a no flow condition, as required by the desired geometrical configuration of the part being processed. It is this starting and stopping of the cutting stream that demands an accurate and dependable delivery system because it is desirable for the flow of abrasives to be accurately timed to begin and end in coordination with the flow of water. However, several factors must be taken into consideration with regard to the timing of the waterjet cutting system.

First, to facilitate delivery of the abrasive material, it is necessary for the water flow to have begun, thus generating vacuum assist for abrasive delivery. Second, once the water flow has begun, abrasive particulate must be supplied in a controllable manner to facilitate efficient cutting of the material being processed. In the most efficient scenario, the least amount of abrasive particulate required to cut or abrade the target material is introduced to the water stream, thus minimizing any waste of the abrasive particulate. Third, the flow of abrasive particulate must be completely stopped when cutting or abrading is finished. However, water flow must not be stopped until after the last of the abrasive media in the supply conduit is expelled. If abrasive flow continues after the water flow has stopped, or does not cease far enough in advance of the water flow, abrasives may remain in the supply conduit and prevent venturi action from occurring at start-up of the next cycle. Lack of venturi action and, more specifically, the vacuum it creates will impair the transfer of abrasive particulate from the supply conduit to the waterjet cutting machine nozzle, and may halt the cutting process.

Notwithstanding the waterjet cutting systems of prior art, there has been a long felt need to improve upon their performance. For instance, one concern of waterjet cutting systems is to regulate the flow of abrasives so as to use the least amount of abrasive particulate required to efficiently cut the material being processed. Typical materials to be processed may require as little as ½ lb. to as great as 2 lbs. of abrasive particulate per minute of water flow. Precise control is required so as to limit the amount of abrasive particulate material wasted. It is also of importance that multiple abrasive waterjet cutting nozzles operating in tandem be supplied with equal amounts of abrasive particulates so as to perform uniformly and consistently.

There has also been a need to improve the reliability and durability of existing waterjet cutting devices. Particularly waterjet cutting devices in accordance with the prior art have been plagued by the internal scouring effect of the abrasive particulate as it passes through the system. This scouring impedes the waterjet cutting devices of the prior art from working efficiently, or from even working at all.

SUMMARY OF THE INVENTION

The present invention overcomes the shortcomings of the prior art by providing an efficient waterjet cutting system and method. The present invention also provides a highly reliable abrasive particulate material delivery system which is capable of providing accurate calibration and rapid interruption of material flow.

In accordance with one embodiment of the present invention, there is described a waterjet cutting system comprising a storage assembly in which abrasive particulate material is retained. The storage assembly includes an inlet for allowing the abrasive particulate material to flow therein, an outlet for allowing the abrasive particulate material to flow therefrom, and an inflatable diaphragm arranged at the outlet such that the inflatable diaphragm may be selectively inflated and deflated to control the flow of abrasive particulate material through the outlet. In this embodiment, the waterjet cutting system further includes a liquid supply source in communication with the storage assembly whereby the abrasive particulate material is mixed with a predetermined amount of liquid.

In accordance with another embodiment of the present invention, the waterjet cutting system further comprises a computer numeric control (CNC) system and a pressurized air supply source operatively connected to the inflatable diaphragm for selectively inflating and deflating said inflatable diaphragm.

In accordance with another embodiment of the present invention, the waterjet cutting system further comprises an air regulator device operatively connected to the pressurized air supply source for regulating the pressure of air supplied to inflate the inflatable diaphragm.

In accordance with another embodiment of the present invention, the waterjet cutting system further comprises a nozzle connected to the liquid supply source such that the abrasive particulate material and liquid may be dispersed from the nozzle at a predetermined pressure.

In accordance with another embodiment of the present invention, the storage assembly of the waterjet cutting system further comprises an upper housing retaining at least a portion of the outlet, and a lower housing connected to the upper housing. In this embodiment, the upper and lower housing have a passageway therein for permitting abrasive particulate material to flow therethrough.

In accordance with another embodiment of the present invention, waterjet cutting system storage assembly further comprises an over-inflation guard block connected to the upper housing and arranged at the outlet to prevent over expansion of the inflatable diaphragm.

In accordance with another embodiment of the present invention, the waterjet cutting system further comprises a regulation device arranged between the upper and lower housing where the regulation device regulates the amount of abrasive particulate material permitted to flow through the outlet.

In accordance with another embodiment of the present invention, the regulation device comprises a regulator orifice and a pivot pin. In this embodiment, the regulator orifice is rotatable about the pivot pin between predetermined limits to define full flow and no flow conditions.

In accordance with another embodiment of the present invention, there is provided an abrasive material delivery assembly for use with a waterjet cutting system. The abrasive material delivery assembly comprises a storage assembly in which abrasive particulate material is retained. The storage assembly includes an inlet for allowing the abrasive particulate material to flow therein, an outlet for allowing the abrasive particulate material to flow therefrom, and an inflatable diaphragm arranged at the outlet such that the inflatable diaphragm may be selectively inflated and deflated to control the flow of abrasive particulate material through through outlet.

In accordance with another embodiment of the present invention, the abrasive material delivery assembly further comprises a pressurized air supply source operatively connected to the inflatable diaphragm for selectively inflating and deflating the inflatable diaphragm.

In accordance with another embodiment of the present invention, the CNC system of the abrasive material delivery assembly further comprises an air regulator device operatively connected to the pressurized air supply source for regulating the pressure of air supplied to inflate the inflatable diaphragm.

In accordance with another embodiment of the present invention, the storage assembly of the abrasive material delivery assembly further comprises an upper housing retaining at least a portion of the outlet, and a lower housing connected to the upper housing. The upper and lower housings have a passageway therein for permitting abrasive particulate material to flow therethrough.

In accordance with another embodiment of the present invention, the storage assembly of the abrasive material delivery assembly further comprises an over-inflation guard block connected to the upper housing and arranged at the outlet to prevent over expansion of the inflatable diaphragm.

In accordance with another embodiment of the present invention, the abrasive material delivery assembly further comprises a regulation device arranged between the upper and lower housings and operable to regulate the amount of abrasive particulate material permitted to flow through the outlet.

In accordance with another embodiment of the present invention, the regulation device of the abrasive material delivery assembly comprises a regulator orifice and a pivot pin. The regulator orifice is rotatable about the pivot pin between predetermined limits to define full flow and no flow conditions.

In accordance with another embodiment of the present invention, the storage assembly of the abrasive material delivery assembly further compromises a vacuum break system. The vacuum break system comprises an air feed tube with a first end and a second end. The first end is attached to the outlet and the second end is positioned within the storage assembly at a level above that of the abrasive particulate material. The vacuum break system further comprises a filter element in communication with the interior and exterior of the storage assembly for allowing atmospheric air to enter the storage assembly. The vacuum break system is operable to selectively reduce vacuum pressure at the outlet.

In accordance with further aspects of the invention, the invention provides a method of controlling the flow of abrasive particulate material in a waterjet cutting system comprising the steps of retaining abrasive particulate material in a storage vessel; selectively inflating a diaphragm arranged at an outlet of a storage vessel to preclude the abrasive particulate material from flowing therethrough; selectively deflating the diaphragm to permit the abrasive particulate material to flow through the outlet; mixing the abrasive particulate material with a liquid so that a desired ratio of abrasive particulate material to liquid is created; and, permitting the abrasive particulate material to flow with the liquid through a nozzle of the waterjet cutting apparatus; thus creating an abrasive stream sufficient to abrade a target object.

The method of the present invention may further comprise the step of selectively inflating the diaphragm through the use of an air supply regulator assembly.

The method of the present invention may further comprise the step of utilizing a CNC system to control the air supply regulator assembly.

The method of the present invention may further comprise the step creating a vacuum environment with the storage vessel to facilitate the flow of the abrasive material through the outlet.

The above description, as well as further objects, features and advantages of the present invention will be more fully understood with reference to the following detailed description of the waterjet cutting device and method of operating such device.

DETAILED DESCRIPTION OF THE PREFERRED EMBODIMENTS

Figure 1:
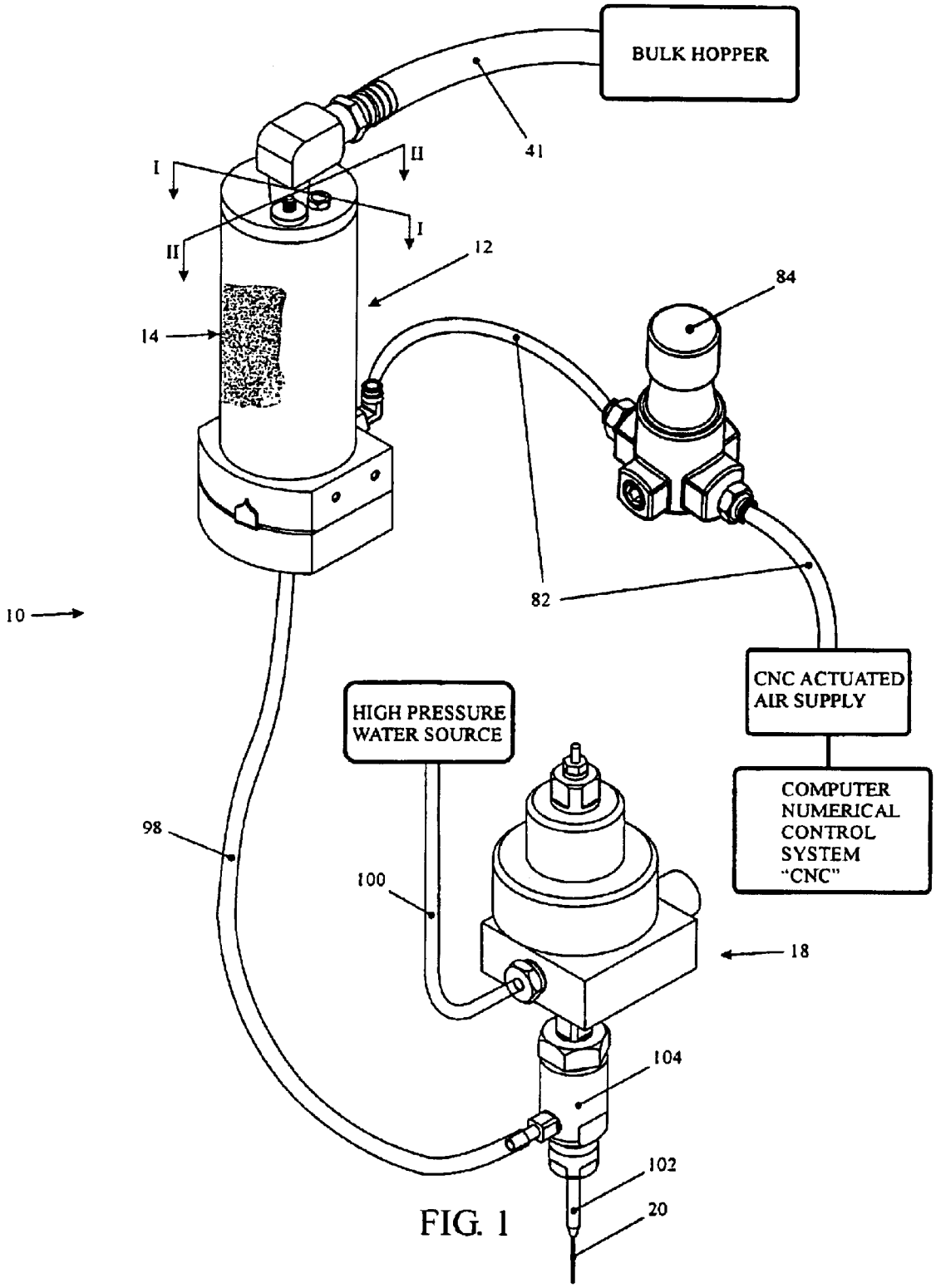
FIG. 1 is a perspective view of the present waterjet cutting system.

Referring now to the drawings, there is shown in FIG. 1 various components of the waterjet cutting system 10 of the present invention. The waterjet cutting system of the present invention comprises a storage assembly 12 for storing abrasive particulate material 14. In a preferred embodiment, a bulk hopper (not shown) may be connected to the storage assembly 12 to provide a constant supply of the abrasive particulate material 14.

A liquid supply assembly 18, an air pressure regulator 84, and an air supply source (not shown) are also operatively connected to the storage assembly 12 as discussed further below.

Figure 2:
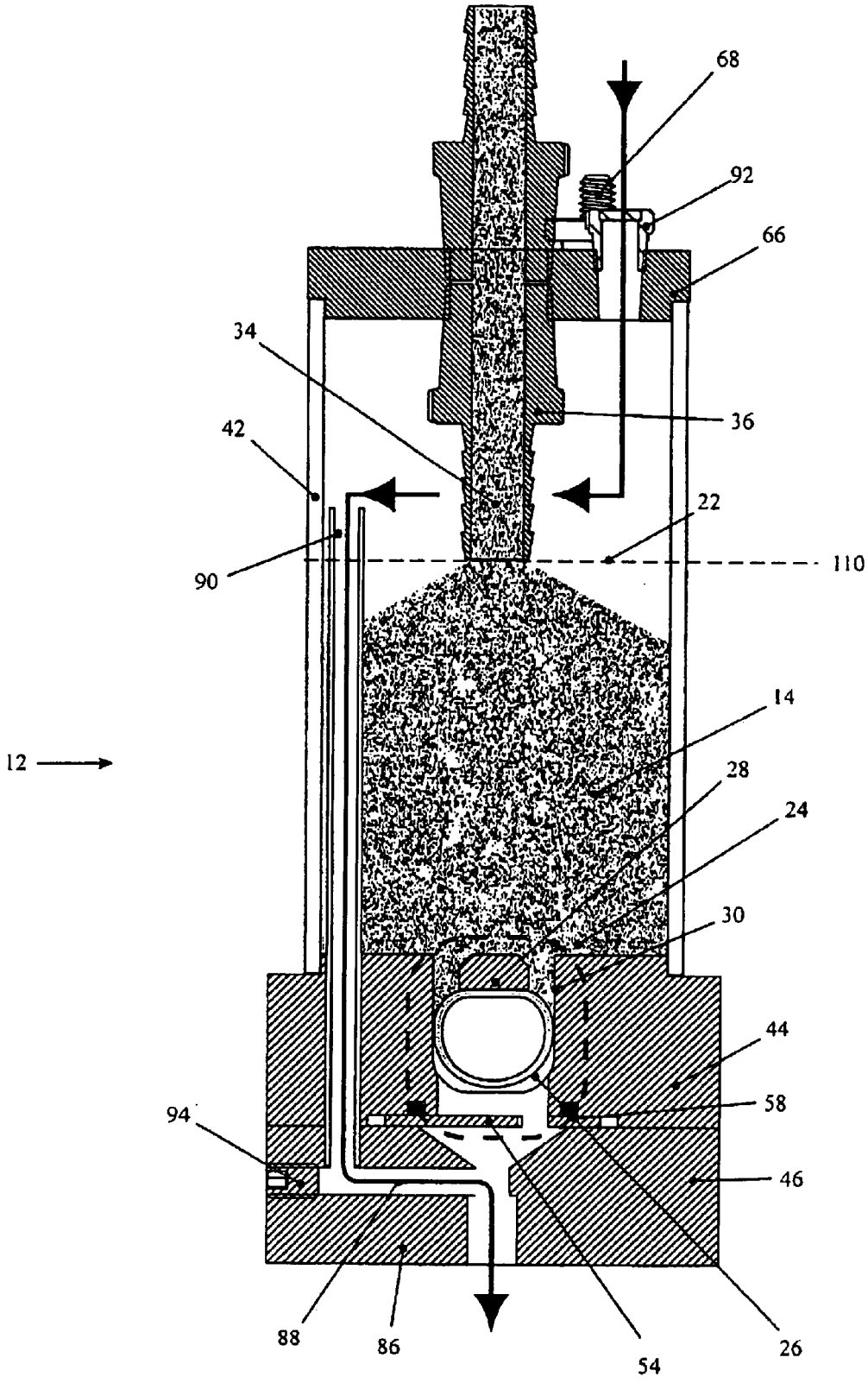
FIG. 2 is an isolated cross-sectional schematic view of a portion of the present waterjet cutting system taken along line A—A of FIG. 1 with the stop diaphragm in an inflated position whereby abrasive particulate material is retained within an associated storage vessel.

As shown in FIG. 2, within the storage assembly 12, there is provided an inlet 22 for allowing the abrasive particulate material 14 to flow therein, an outlet 24 for allowing the abrasive particulate material 14 to flow therefrom, and an inflatable diaphragm 26 arranged at said outlet 24 such that the inflatable diaphragm 26 may be selectively inflated and deflated to control the flow of abrasive particulate material 14 through the outlet 24.

The outlet 24 may have a passageway 32 defined by interior walls 30. An over-inflation guard block 28 may be arranged at the outlet to limit inflation of the inflatable diaphragm 26.

Figure 3:
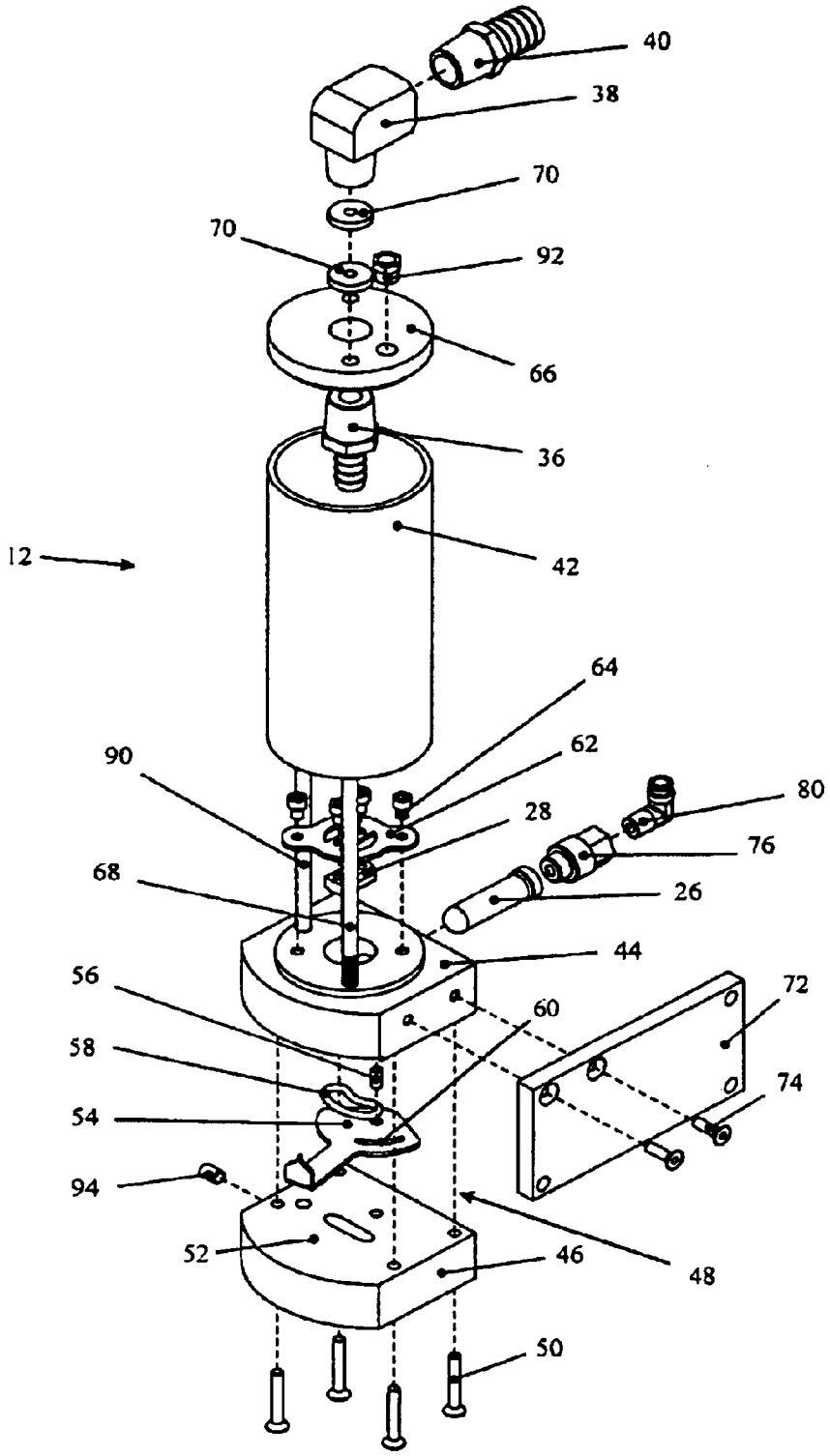
FIG. 3 is an exploded view of a portion of the present waterjet cutting system.

At the inlet 22, there is disposed an inlet passageway 34 through which abrasive particulate material 14 may flow into an associated storage chamber 42. The inlet 22 may comprise a hose barb 36, as shown in FIGS. 2 and 3, or other appropriate device. Typically, the hose barb 36 is in communication with an upper fill elbow 38 connected to an upper fill hose barb 40, such that abrasive particulate material 14 may enter the storage assembly 12 from an upper supply hose 41 laying essentially perpendicular to the inlet passageway 34. It will be appreciated, however, that under certain conditions, it may be preferable for the abrasive particulate material 14 to enter the storage assembly 12 essentially in line with the inlet passageway 34. In such embodiments, the storage assembly 12 may be provided without the upper fill elbow 38. A bulk hopper (not shown) may be used to provided a constant supply of the abrasive particulate material 14 to the storage assembly 12.

Referring now to FIG. 3, the storage assembly 12 further comprises storage chamber 42 for retaining the abrasive particulate material 14. In a preferred embodiment, the storage chamber 42 may be made of polycarbonate material. In alternate embodiments, numerous other materials may be used such as various acrylics, metals, polymers, ceramics and woods.

The storage assembly 12 also includes an upper housing 44 connected to one end of the storage assembly 12, and a lower housing 46 connected to, and in communication with the upper housing 44. A regulator assembly 48 is provided between the upper and lower housings 44 and 46 for varying the rate of flow of the abrasive particulate material 14 permitted to flow through the outlet 24, as will be discussed in greater detail below. Typically, the upper and lower housing 44 and 46 are joined by lower housing screws 50. Alternatively, they could be connected by other suitable connection devices, such as rivets, clamps, adhesives and the like In the preferred embodiment shown in FIG. 3, the lower housing 46 further comprises a slotted passageway 52 through which abrasive particulate material 14 may pass.

The regulator assembly 48 further comprises a regulator plate 54 and a pivot pin 56, about which the regulator plate 54 is rotatably mounted. A regulator O-ring 58 arranged between the upper housing 44 and regulator plate 54. The regulator plate 54 includes a slot 60 shown in FIGS. 3, 6A, 7A and 8A as having an arcuate elongated configuration. It should be appreciated however, that in alternate embodiments, the slot 60 may have numerous geometric configurations, which are suitable for regulating the flow of material from the storage chamber 42, as will be discussed hereinafter.

Referring now to the storage assembly 12 as depicted in FIGS. 2–5B, a diaphragm over-inflation guard plate 62 is connected to a surface of the upper housing by a plurality of guard plate screws 64, and is arranged at the outlet of the storage chamber 42. The diaphragm over-inflation guard plate 62 will reduce the risk of over inflating the inflatable diaphragm 26 and will prevent such inflatable diaphragm 26 from extending into the storage chamber 42.

The storage assembly 12 further comprises a lid 66 in communication with the storage chamber 42 for maintaining an air-tight enclosure. The lid 66 may be secured to the upper housing 44 by threaded rods 68 and corresponding thumbnuts 70.

The storage assembly 12 may also comprise support means, such as a mounting bracket 72 secured to the upper housing via mounting bracket screws 74, and secured to a system mounting fixture (not shown).

Figure 4A:
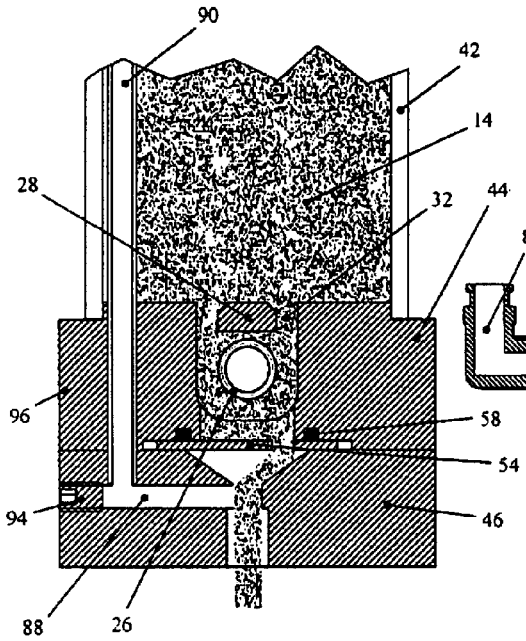
FIG. 4A is an isolated cross-sectional schematic view of a portion of the present waterjet cutting system taken along line A—A of FIG. 1 with the stop diaphragm shown in a deflated position whereby abrasive particulate material is permitted to flow from an associated storage vessel.
Figure 4B:
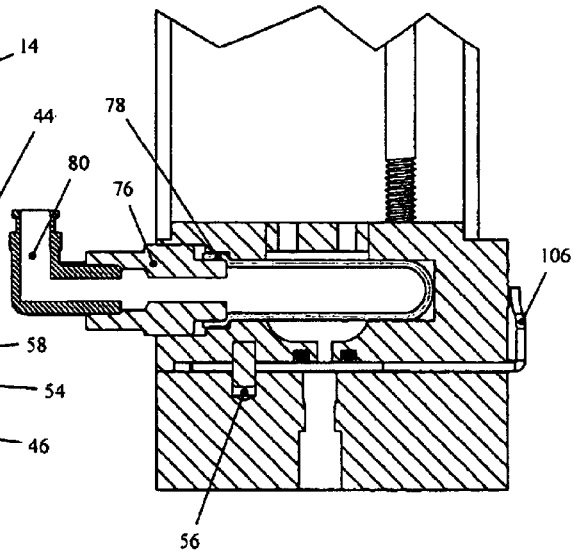
FIG. 4B is an isolated cross-sectional schematic view of a portion of the present waterjet cutting system taken along line B—B of FIG. 1 with the stop diaphragm shown in a deflated position.
Figure 5A:
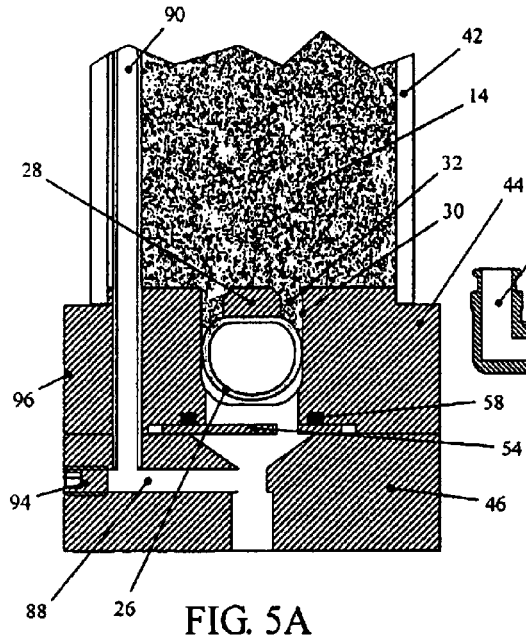
FIG. 5A is an isolated cross section view of a selected portion of the present waterjet cutting system taken along line A—A of FIG. 1 with the stop diaphragm shown in an inflated position so that abrasive particulate material is retained within an associated storage vessel.
Figure 5B:
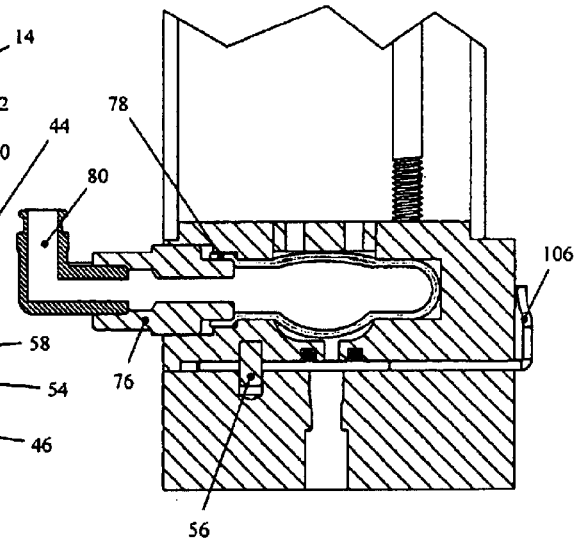
FIG. 5B is an isolated cross section view of a selected portion of the present waterjet cutting system taken along line B—B of FIG. 1 with the stop diaphragm shown in an inflated position.

Referring now to FIGS. 4A and 4B, there are shown isolated cross-sectional schematic views of a selected portion of the present storage assembly 12 illustrating the inflatable diaphragm 26 in a deflated position. The inflatable diaphragm 26 is shown in communication with a diaphragm screw 76 for securing the inflatable diaphragm 26 to the upper housing 44 via compression against two mating surfaces 78. In communication with the diaphragm screw 76, there is shown a quick connector 80, for the purpose of securing an air supply line 82 to the diaphragm screw 76. In series with the air supply line 82 is a regulator for controlling the amount of pressurized air, provided by a pressurized air source (not shown), permitted to flow into the inflatable diaphragm 26.

The waterjet cutting device may also comprise a vacuum break system 86, which, in the embodiment of FIG. 2, is incorporated into the storage assembly 12. The vacuum break system 86 comprises a passageway 88 in communication with the storage assembly outlet 24 for the purpose of mixing filtered air from within the storage assembly 12 with the abrasive particulate material 14 passing through the outlet 24. An air feed tube 90 extends within the storage assembly 12 and above the level 110 of the hose barb 36 to collect the air to be mixed with the abrasive particulate material 14. An air filter 92 is disposed on the lid 66 of the storage assembly to permit filtered air to be drawn into the storage assembly 12.

In the embodiment shown in FIG. 2, the upper housing 44 is machined from a solid piece of material. As such, in order to create the vacuum passageway 88, the housing material may be drilled or tapped at right angles from the top of the upper housing 44 and the side of the upper housing 44, along the paths of the intended vacuum passageway 88 and air feed tube 90. A block screw 94 is engaged within the sidewall 96 of the upper housing 44 such that the portion of the passageway 88 extending to the atmosphere through the side wall 96 of the upper housing 44 is sealed air-tight.

During operation of the waterjet cutting system 10, abrasive particulate material 14 is supplied from the bulk storage hopper (not shown) to the storage assembly 12 via the upper supply hose 41. The storage assembly 12 thereafter dispenses with the abrasive particulate material 14 on demand as permitted by the diaphragm 26 which can be inflated by pressurized air supplied from a pressurized air source (not shown) through a regulator 84 and associated air supply lines 82. The supply of air is typically CNC actuated, and is fully coordinated with the cutting movements. Similarly, deflation of the diaphragm 26 is controlled by the CNC device (not shown).

Regulated and intermittently switched abrasive particulate material 14 flows out of the storage assembly 12 through a lower supply hose 98 and enters the liquid supply assembly 18. At this point, the abrasive particulate material is mixed with high pressure water from a supply tube 100 and the mixture exits through the cutting nozzle 102 as an abrasive stream 20.

It will be appreciated that the cutting nozzle 102 may be formed to a variety of geometric configurations, but is typically conical, with the smaller diameter near its outlet to effectuate an accurate and controlled abrasive stream 20. This configuration also serves to create a venturi effect which pulls abrasive particulate material 14 into the cutting nozzle 102 by its vacuum.

Abrasive particulate materials 14 contemplated for use in the present invention are known in the art. For example, the abrasive particulate material 14 may include, but is not limited to, garnet, silica, aluminum oxide, and the like. In addition, it should be understood that the term "water" is intended to include not only water, but various other liquids that may be used as a medium for carrying abrasive particulate materials to the nozzle of the waterjet cutting device. Similarly, as use herein, the term "waterjet cutting device" should be construed to include any type of cutting device that utilizes liquid in combination with an abrasive material to cut or abrade target objects made of various materials.

Referring now to FIG. 3, there is shown an exploded view of the storage assembly 12. During operation of the waterjet cutting system 10, the storage chamber 42 is filled with abrasive particulate material 14 supplied by the upper supply hose 41. The upper supply hose 41 is connected to the storage assembly through the upper fill hose barb 40 mounted on the top of the storage assembly 12 for this purpose, as previously described. The arrangement of the storage assembly 12 creates an airtight seal so that the abrasive particulate material 14 is delivered in an efficient and substantially contaminant free manner.

From the storage chamber 42, the abrasive particulate material 14 enters the upper housing 44 at the outlet 24. If the inflatable diaphragm 26 is at least in a partially deflated condition, the abrasive particulate material 14 then flows past the diaphragm over-inflation guard block 28 and around the partially deflated inflatable diaphragm 26. Passing through the slot 60 and entering the lower housing slotted passageway 52, the abrasive particulate material 14 is funneled through the top of the lower housing 46, mixes with an air stream of the vacuum break system 86, and exits via vacuum out of the bottom of the lower housing 46 to the lower supply tube 98, which itself is part of the storage assembly 12. In certain preferred embodiments, where the storage chamber 42 is above the outlet 24, this process is also assisted by gravity.

Referring to FIGS. 4A and 4B, there are shown isolated cross sectional views of the storage assembly 12 of the present waterjet cutting system 10 with the inflatable diaphragm 26 shown in the deflated position, whereby abrasive particulate material 14 is permitted to flow freely thereby, as discussed above. Adding pressurized air via the regulator assembly 84 and associated air supply lines 82 serve to inflate the inflatable diaphragm 26 to the position shown in FIGS. 5A and 5B, whereby abrasive particulate material 14 is prevented from flowing thereby. Typically, such inflation is precisely coordinated and controlled by the CNC device, but may in alternate embodiments be done manually by an operator.

If allowed to expand without restriction, the inflatable diaphragm 26 would inflate into the storage chamber 42 and could possibly burst. To prevent such over-inflation, the diaphragm over-inflation guard block 28 is mounted above the inflatable diaphragm 26, effectively constraining it between the over-inflation guard block 28 and inner walls of the upper housing 44.

In a preferred embodiment, air pressure supplied to the inflatable diaphragm 26 is carefully regulated via an external air pressure regulator 84 to maintain pressure at approximately 30–40 psi. It is within this pressure range that the stop diaphragm 15 will operate at maximum efficiency. However, in alternate embodiments, air pressures substantially less or greater than the above preferred range can be applied.

The inflatable diaphragm 26 is used to control the flow of abrasive particulate material 14 from the storage assembly 12. As is shown in FIGS. 4A–4B (deflation) and 5A–5B (inflation), the flow of abrasive particulate material 14 may be controlled from 0% to 100% flow. Prior art waterjet cutting devices rely on a moving arm, slide or stopper to adjust the flow rate. Because the operating environment of these systems are such that all surfaces exposed to the abrasive particulate material 14 are subject to the materials abrasive effects, the end result of continuous operation is degradation of precisely fitting parts to the point of failure. The new design of the present invention relies on the abrasion resistant nature of rubber, and its ability to conform to a sealing surface that will change due to wear. Therefore, positive mating continues throughout a useful life of the waterjet cutting system 10 even as the inner walls of the upper housing 44 and the underside of the diaphragm over-inflation guard block 28—which together define the limits of inflation of the stop diaphragm gradually scour.

Figure 6A:
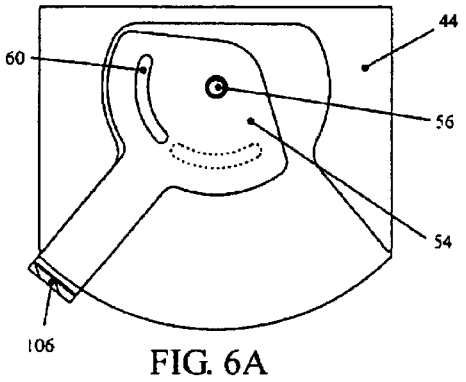
FIG. 6A is an isolated top plan view of a metering assembly of the present invention shown in a closed position.
Figure 6B:
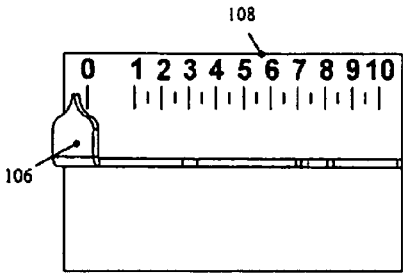
FIG. 6B is a front elevational view of the metering assembly shown in FIG. 6A.
Figure 7A:
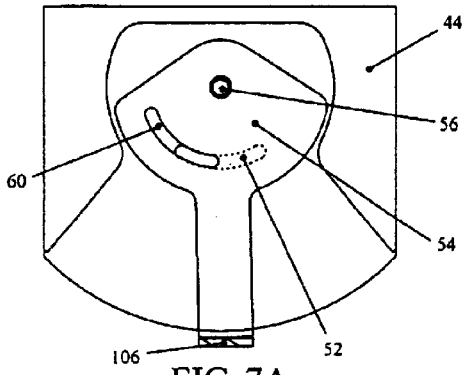
FIG. 7A is an isolated top plan view of the metering assembly of FIG. 6 shown in a partially open position.
Figure 7B:
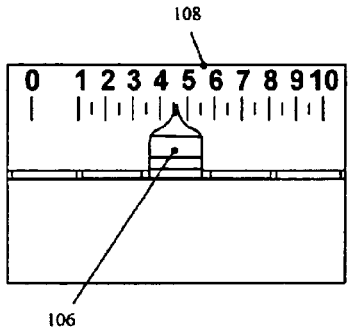
FIG. 7B is a front elevational view of the metering assembly shown in FIG. 7A.
Figure 8A:
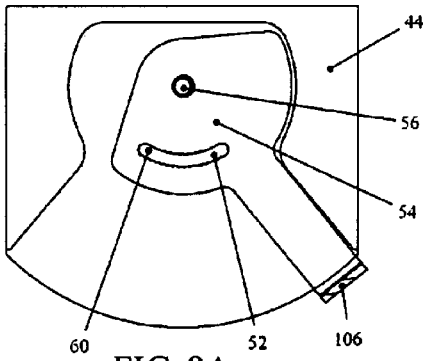
FIG. 8A is an isolated top plan view of the metering assembly shown in FIGS. 6 and 7 shown in the fully open position.
Figure 8B:
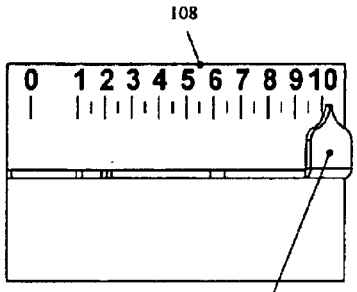
FIG. 8B is a front elevational view of the metering assembly shown in FIG. 8A.

As shown in FIGS. 6–8, the regulator plate 54 containing the elongated arcuate slot 60 is situated between the upper housing 44 and lower housing 46 for the purpose of regulating the volume of abrasive particulate material 14 permitted to flow to the abrasive cutting head 104. Such regulation is achieved by adjusting the area of the slot 60 through which abrasive particulate material flows. Adjustment of the slot 60 is conducted by pivoting the regulator plate 54 about the pivot pin 56, which adjusts the overlapping area of the slot 60 and the corresponding slotted passageway 52 in the lower housing 46. Flow rate is proportional to the area in which the regulator orifice void 60 overlaps the lower housing slotted passageway 52. As such, calibration of flow rate for the system is accomplished by means of an aligning pointer 106 situated at the end of the regulator plate 54 and corresponding to the degree of slot overlap.

The aligning pointer 106 is calibrated to a scale 108 on the exterior of the upper housing 44, as shown in FIGS. 6–8. Typically, the scale 108 is calibrated to show the percentage of correspondence between the regulator orifice void 60 and the lower housing slotted passageway 52.

The embodiment of FIG. 6 depicts the regulator plate 54 in the "OFF" position, or low point of its travel, equating to a 0% of maximum flow rate. Such a position effectively blocks the passage of abrasive particulate material 14 through the storage assembly outlet 24 and prevents any such material from entering the abrasive cutting head 104. Whenever supply pressure is removed from the overall system (waterjet cutting machine) as in end of day shutdown, the regulator plate 54 must be in this position to prevent backward "flooding" of the system as the inflatable diaphragm 26 deflates (See FIGS. 4A and 4B).

The embodiment of FIG. 7 depicts the regulator plate 54 set at about the midpoint of its travel, equating to approximately a 50% of maximum abrasive feed rate. The embodiment of FIG. 8 depicts the regulator plate 54 set at the highpoint of its travel, equating to a 100% of maximum abrasive feed rate.

In addition, abrasive particulate material 14 is prevented from bypassing the regulator plate 54 by means of a regulator O-ring 58 situated between the bottom of the upper housing 44 and top of the regulator plate 54.

Referring to FIG. 2, there is shown is a cross-sectional view of a portion of the storage assembly 12 of the present invention with abrasive particulate material 14 stored within the storage chamber 42 and the inflatable diaphragm 26 in the inflated position. Abrasive particulate material 14 enters the storage chamber 42 at the inlet 22 through the upper fill hose barb 40 and passes through the lower fill hose barb 36. The maximum fill level of abrasive particulate material in the storage assembly is preset by the position of the lower fill hose barb 110. Once within the storage assembly 12, the abrasive particulate material 14 may be permitted to flow to the outlet 24, pass the inflatable diaphragm 26, and through the upper housing 44 as shown in FIGS. 4A and 4B.

During cutting, the waterjet cutting nozzle 102 generates a vacuum via venturi action and draws abrasives 14 into the cutting head 104 (see FIG. 1). If the storage chamber 42 is a sealed unit, as necessary in the environment in which it operates, the vacuum drawn would consume several times the required amount of media 14. Therefore, a vacuum break system 86 is necessary and begins at the lid 66 of the storage assembly 12 where air is drawn into the storage chamber 42 through an air filter element 92, which is installed through the lid 66. Once inside the storage chamber 42, the air circulates and is drawn through the air feed tube 90, which is positioned above the maximum fill level 110 of abrasive particulate 14 inside the storage assembly 12. Exiting the storage assembly 12, the air feed tube 90 passes through the cross hole 88 which is blocked externally by the block screw 94. Air then mixes with abrasive flow 14 and exits the storage assembly 12, thus reducing the vacuum pressure associated with the abrasive flow.

This vacuum break system 86 marks a noted improvement over the prior art in that the abrasive particulate materials 14 path from the storage assembly 12 to the abrasive stream 20 is substantially sealed from contamination during cutting. On existing systems, a vent to the atmosphere is provided directly between the flow of abrasives and the harsh cutting environment. This allows for the entrance of water and particles of abraded material, which typically clog the system. The new design vents internally, thus essentially preventing contamination from the material being cut or from water entering into the system.

Although the invention herein has been described with reference to particular embodiments, it is to be understood that the embodiments are merely illustrative of the principles and applications of the present invention. It is therefore to be understood that numerous modifications may be made to the embodiments and that other arrangements may be devised without departing from the spirit and scope of the present invention as defined by the claims.

What is claimed is:

1. A waterjet cutting system comprising:

(a) a storage assembly in which abrasive particulate material is retained, said storage assembly including an inlet for allowing the abrasive particulate material to flow therein, an outlet for allowing the abrasive particulate material to flow therefrom, and an inflatable diaphragm arranged within said outlet such that said inflatable diaphragm is selectively inflated and deflated to seal and unseal said outlet thereby controlling the flow of abrasive particulate material through said outlet, and (b) a liquid supply source in communication with said storage assembly whereby said abrasive particulate material is mixed with a predetermined amount of liquid.

2. The waterjet cutting system of claim 1, further comprising a computer numeric control (CNC) system and a pressurized air supply source operatively connected to said inflatable diaphragm for selectively inflating and deflating said inflatable diaphragm.

3. The waterjet cutting system of claim 2, further comprises an air regulator device operatively connected to said pressurized air supply source for regulating the pressure of air supplied to inflate the inflatable diaphragm.

4. The waterjet cutting system of claim 1, further comprising a nozzle connected to said liquid supply source such that said abrasive particulate material and liquid is dispersed from said nozzle at a predetermined pressure.

5. The waterjet cutting system of claim 1, wherein said storage assembly further comprises an upper housing, said upper housing retaining at least a portion of said outlet, and a lower housing connected to said upper housing, said upper and lower housing having a passageway therein for permitting abrasive particulate material to flow therethrough.

6. The waterjet cutting system of claim 5, wherein said storage assembly further comprises an over-inflation guard block connected to said upper housing and arranged at said outlet to prevent over expansion of said inflatable diaphragm.

7. The waterjet cutting system of claim 5, further comprising a regulation device arranged between said upper and lower housing, said regulation device being operable to regulate the amount of abrasive particulate material permitted to flow through said outlet.

8. The waterjet cutting system of claim 7, wherein said regulation device comprises a regulator orifice and a pivot pin, wherein said regulator orifice is rotatable about said pivot pin between predetermined limits to define full flow and no flow conditions.

9. An abrasive material delivery assembly for use with a waterjet cutting system, said abrasive material delivery assembly comprising: a storage assembly in which abrasive particulate material is retained, said storage assembly including an inlet for allowing the abrasive particulate material to flow therein, an outlet for allowing the abrasive particulate material to flow therefrom, and an inflatable diaphragm arranged within said outlet such that said inflatable diaphragm is selectively inflated and deflated seal and unseal said outlet thereby controlling the flow of abrasive particulate material through said outlet.

10. The abrasive material delivery assembly of claim 9, further comprising a pressurized air supply source operatively connected to said inflatable diaphragm for selectively inflating and deflating said inflatable diaphragm.

11. The abrasive material delivery assembly of claim 10, further comprising an air regulator device operatively connected to said pressurized air supply source for regulating the pressure of air supplied to inflate the inflatable diaphragm.

12. The abrasive material delivery assembly of claim 9, wherein said storage assembly further comprises an upper housing, said upper housing retaining at least a portion of said outlet, and a lower housing connected to said upper housing, said upper and lower housing having a passageway therein for permitting abrasive particulate material to flow therethrough.

13. The abrasive material delivery assembly of claim 12, wherein said storage assembly further comprises an over-inflation guard block connected to said upper housing and arranged at said outlet to prevent over expansion of said inflatable diaphragm.

14. The abrasive material delivery assembly of claim 12, further comprising a regulation device arranged between said upper and lower housing, said regulation device being operable to regulate the amount of abrasive particulate material permitted to flow through said outlet.

15. The abrasive material delivery assembly of claim 14, wherein said regulation device comprises a regulator orifice and a pivot pin, wherein said regulator orifice is rotatable about said pivot pin between predetermined limits to define full flow and no flow conditions.

16. The abrasive material delivery assembly of claim 9, wherein the storage assembly further compromises a vacuum break system, said vacuum break system comprising an air feed tube with a first end and a second end, said first end being attached to said outlet and said second end positioned within the storage assembly at a level above that of the abrasive particulate material, and a filter element in communication with the interior and exterior of the storage assembly for allowing atmospheric air to enter the storage assembly, said vacuum break system being operable to selectively reduce vacuum pressure at said outlet.

17. A method of controlling the flow of abrasive particulate material in a waterjet cutting system comprising the steps of:

retaining abrasive particulate material in a storage vessel;

selectively inflating a diaphragm arranged within an outlet of a storage vessel to seal and unseal the outlet thereby precluding the abrasive particulate material from flowing therethrough;

selectively deflating the diaphragm to permit the abrasive particulate material to flow through the outlet;

mixing the abrasive particulate material with a liquid so that a desired ratio of abrasive particulate material to liquid is created; and permitting the abrasive particulate material to flow with the liquid through a nozzle of the waterjet cutting apparatus, thus creating an abrasive stream to abrade a target object.

18. The method of claim 17, wherein said step of selectively inflating the diaphragm is performed through the use of an air supply regulator assembly.

19. The method of claim 18, further comprising using a CNC system to control the air supply regulator assembly.

20. The method of claim 17, further comprising creating a vacuum environment with the storage vessel to facilitate the flow of the abrasive material through the outlet.

21. A waterjet cutting system comprising:

(a) a storage assembly in which abrasive particulate material is retained, said storage assembly including an inlet for allowing the abrasive particulate material to flow therein, an outlet for allowing the abrasive particulate material to flow therefrom, and an inflatable diaphragm arranged at said outlet such that said inflatable diaphragm is selectively inflated and deflated to control the flow of abrasive particulate material through said outlet, (b) a liquid supply source in communication with said storage assembly whereby said abrasive particulate material is mixed with a predetermined amount of liquid, and (c) a computer numeric control (CNC) system and a pressurized air supply source operatively connected to said inflatable diaphragm for selectively inflating and deflating said inflatable diaphragm.

22. The waterjet cutting system of claim 21, further comprises an air regulator device operatively connected to said pressurized air supply source for regulating the pressure of air supplied to inflate the inflatable diaphragm.

23. The waterjet cutting system of claim 22, further comprising a nozzle connected to said liquid supply source such that said abrasive particulate material and liquid may be dispersed from said nozzle at a predetermined pressure.

24. The waterjet cutting system of claim 21, wherein said storage assembly further comprises an upper housing, said upper housing retaining at least a portion of said outlet, and a lower housing connected to said upper housing, said upper and lower housing having a passageway therein for permitting abrasive particulate material to flow therethrough.

25. The waterjet cutting system of claim 24, wherein said storage assembly further comprises an over-inflation guard block connected to said upper housing and arranged at said outlet to prevent over expansion of said inflatable diaphragm.

26. The waterjet cutting system of claim 24, further comprising a regulation device arranged between said upper and lower housing, said regulation device being operable to regulate the amount of abrasive particulate material permitted to flow through said outlet.

27. The waterjet cutting system of claim 26, wherein said regulation device comprises a regulator orifice and a pivot pin, wherein said regulator orifice is rotatable about said pivot pin between predetermined limits to define full flow and no flow conditions.

28. An abrasive material delivery assembly for use with a waterjet cutting system, said abrasive material delivery assembly comprising: a storage assembly in which abrasive particulate material is retained, said storage assembly including an inlet for allowing the abrasive particulate material to flow therein, an outlet for allowing the abrasive particulate material to flow therefrom, and an inflatable diaphragm arranged at said outlet such that said inflatable diaphragm is selectively inflated and deflated to control the flow of abrasive particulate material through said outlet; and a pressurized air supply source operatively connected to said inflatable diaphragm for selectively inflating and deflating said inflatable diaphragm.

29. The abrasive material delivery assembly of claim 28, further comprising an air regulator device operatively connected to said pressurized air supply source for regulating the pressure of air supplied to inflate the inflatable diaphragm.

30. The abrasive material delivery assembly of claim 28, wherein said storage assembly further comprises an upper housing, said upper housing retaining at least a portion of said outlet, and a lower housing connected to said upper housing, said upper and lower housing having a passageway therein for permitting abrasive particulate material to flow therethrough.

31. The abrasive material delivery assembly of claim 30, wherein said storage assembly further comprises an over-inflation guard block connected to said upper housing and arranged at said outlet to prevent over expansion of said inflatable diaphragm.

32. The abrasive material delivery assembly of claim 30, further comprising a regulation device arranged between said upper and lower housing, said regulation device being operable to regulate the amount of abrasive particulate material permitted to flow through said outlet.

33. The abrasive material delivery assembly of claim 32, wherein said regulation device comprises a regulator orifice and a pivot pin, wherein said regulator orifice is rotatable about said pivot pin between predetermined limits to define full flow and no flow conditions.

34. The abrasive material delivery assembly of claim 28, wherein the storage assembly further compromises a vacuum break system, said vacuum break system comprising an air feed tube with a first end and a second end, said first end being attached to said outlet and said second end positioned within the storage assembly at a level above that of the abrasive particulate material, and a filter element in communication with the interior and exterior of the storage assembly for allowing atmospheric air to enter the storage assembly, said vacuum break system being operable to selectively reduce vacuum pressure at said outlet.

35. A method of controlling the flow of abrasive particulate material in a waterjet cutting system comprising the steps of:

retaining abrasive particulate material in a storage vessel;

selectively inflating, through the use of an air supply regulator assembly, a diaphragm arranged at an outlet of a storage vessel to preclude the abrasive particulate material from flowing therethrough;

selectively deflating the diaphragm to permit the abrasive particulate material to flow through the outlet;

mixing the abrasive particulate material with a liquid so that a desired ratio of abrasive particulate material to liquid is created; and permitting the abrasive particulate material to flow with the liquid through a nozzle of the waterjet cutting apparatus, thus creating an abrasive stream to abrade a target object.

36. The method of claim 35, wherein said step of selectively inflating the diaphragm is performed through the use of an air supply regulator assembly.

37. The method of claim 35, further comprising using a CNC system to control the air supply regulator assembly.

38. The method of claim 35, further comprising creating a vacuum environment with the storage vessel to facilitate the flow of the abrasive material through the outlet.

* * * * *

UNITED STATES PATENT AND TRADEMARK OFFICE

CERTIFICATE OF CORRECTION

PATENT NO. : 6,827,637 B2 
DATED : December 7, 2004
INVENTOR(S) : David M. Lewin and Timothy D. O'Keeffe It is certified that error appears in the above-identified patent and that said Letters Patent is hereby corrected as shown below:

Column 1,
Line 48, "power assisted" should be -- power-assisted --.

Column 4,
Line 52, "the step creating" should be -- the step of creating --.

Column 6,
Line 31, "housing" should be -- housings --.
Line 34, "the like In the preferred" should be -- the like. In the preferred --.
Line 39, "O-ring arranged" should be -- O-ring is arranged --.
Line 54, "of over inflating the inflatable" should be -- of over-inflating the inflatable --.

Column 8,
Line 40, "lines serve to" should be -- lines serves to --.

Column 10,
Line 24, "particulate materials" should be -- particulate material's --.
Line 64-65, "further comprises an air" should be -- further comprising an air --.

Column 11,
Line 9, "and lower housing having" should be -- and lower housings having --.
Line 14, "prevent over expansion" should be -- prevent over-expansion--.
Line 18, "lower housing," should be -- lower housings, --.
Line 34, "deflated seal and" should be -- deflated to seal and --.
Line 50, "lower housing having" should be -- lower housings having --.
Line 56, "over expansion" should be -- over-expansion --.
Line 60, "lower housing," should be -- lower housings, --.

Column 12,
Line 2, "further compromises a" should be -- further comprises a --.
Line 57, "comprises an air" should be -- comprising an air --.

Column 13,
Line 1, "lower housing" should be -- lower housings --.
Line 6, "over expansion" should be -- over-expansion --.
Line 10, "lower housing," should be -- lower housings, --.
Line 40, "lower housing having" should be -- lower housings having --.
Line 46, "over expansion" should be -- over-expansion --.

UNITED STATES PATENT AND TRADEMARK OFFICE

CERTIFICATE OF CORRECTION

PATENT NO. : 6,827,637 B2 
DATED : December 7, 2004
INVENTOR(S) : David M. Lewin and Timothy D. O'Keeffe It is certified that error appears in the above-identified patent and that said Letters Patent is hereby corrected as shown below:

Column 14,
Line 1, "lower housing," should be -- lower housings, --.
Line 10, "further compromises" should be -- further comprises --.

Signed and Sealed this

Tenth Day of May, 2005

JON W. DUDAS
*Director of the United States Patent and Trademark Office*